US006906275B2

(12) United States Patent
Koyama et al.

(10) Patent No.: US 6,906,275 B2
(45) Date of Patent: Jun. 14, 2005

(54) MOVABLE CONTACT UNIT, PANEL SWITCH USING THE SAME AND ELECTRONIC EQUIPMENT HAVING THE PANEL SWITCH

(75) Inventors: Hiromichi Koyama, Katsuta-gun (JP); Koji Sako, Katsuta-gun (JP)

(73) Assignee: Matsushita Electric Industrial Co., Ltd. (JP)

( * ) Notice: Subject to any disclaimer, the term of this patent is extended or adjusted under 35 U.S.C. 154(b) by 294 days.

(21) Appl. No.: 10/292,821

(22) Filed: Nov. 13, 2002

(65) Prior Publication Data

US 2003/0089585 A1 May 15, 2003

(30) Foreign Application Priority Data

Nov. 15, 2001 (JP) ..... 2001-349890

(51) Int. Cl.[7] ..... H01H 3/00
(52) U.S. Cl. ..... 200/516; 200/512; 200/406
(58) Field of Search ..... 200/512–517, 200/406, 5 A; 29/622

(56) References Cited

U.S. PATENT DOCUMENTS 5,225,818 A * 7/1993 Lee et al. ..... 200/314
5,845,766 A * 12/1998 Sako et al. ..... 200/516
5,975,711 A * 11/1999 Parker et al. ..... 200/314
5,986,228 A * 11/1999 Okamoto et al. ..... 200/516
6,417,467 B1 * 7/2002 Yamagata ..... 200/5 A
6,548,778 B2 * 4/2003 Takahashi ..... 200/516
6,604,278 B2 * 8/2003 Sera et al. ..... 200/516
6,634,090 B2 * 10/2003 Koyama et al. ..... 200/517
6,730,869 B2 * 5/2004 Teruyama et al. ..... 200/516
6,768,074 B2 * 7/2004 Iwama ..... 200/515

* cited by examiner

*Primary Examiner*—Michael A. Friedhofer
(74) *Attorney, Agent, or Firm*—Parkhurst & Wendel, L.L.P.

(57) ABSTRACT

A movable contact unit including movable contacts localized in respective through holes of a base sheet formed from a flexible insulation substrate; a cover sheet formed from a flexible insulation substrate bonded on upper surface of the base sheet to hold respective movable contacts in the through holes; a weak adhesive layer applied on bottom surface of the base sheet of the movable contact unit except the through holes; and the movable contact unit bonded on stationary contact substrate having corresponding stationary contacts to respective movable contacts using the weak adhesive layer.

6 Claims, 11 Drawing Sheets

MOVABLE CONTACT UNIT, PANEL SWITCH USING THE SAME AND ELECTRONIC EQUIPMENT HAVING THE PANEL SWITCH

FIELD OF THE INVENTION

The present invention relates to a movable contact unit having a plurality of push switches used in operation section of downsized electronic equipment such as cellular phone and the like, panel switch using the movable contact units and electronic equipment having the panel switch.

BACKGROUND OF THE INVENTION

Nowadays, along with the advance of performance and diversity of downsized electronic equipment such as cellular phones and the like, panel switch having a plurality of arranged push switches and mainly used in operation section of them is required to have high accuracy and usability as well as cheap prices.

A conventional movable contact unit for push switches used in operation section of downsized electronic equipment and a panel switch using the movable contact units are described with reference to FIG. 10 through FIG. 13. Here, perpendicular scale in each drawing is drawn enlarged for easy understanding.

FIG. 10 shows a cross-sectional front view of a conventional movable contact unit, FIG. 11 shows an exploded perspective view of the conventional movable contact unit. In FIG. 11, movable contact 1 formed from a resilient thin metal sheet has a dome shape and base sheet 2 formed from a flexible insulation substrate has a plurality of through holes 2A in predetermined positions. Movable contact 1 is placed in each through hole 2A of base sheet 2. Cover sheet 3 formed from a flexible insulation substrate and coated with adhesive material 3A on bottom surface is bonded on individual convex upper surface of movable contact 1 and is fixed on base sheet 2 to form a movable contact unit 4 having a plurality of push switches.

FIG. 12 shows a cross-sectional front view of a panel switch using an above mentioned conventional movable contact unit, and FIG. 13 shows an exploded perspective view of the panel switch. In FIG. 13, stationary contact substrate 5 has a plurality of stationary contact 7 consisted of central stationary contact 7A and peripheral stationary contact 7B on predetermined positions of hard plate-like insulation board 6. Peripheral edge of each movable contact 1 of movable contact unit 4 is placed on corresponding peripheral stationary contact 7B such that convex bottom surface of movable contact 1 faces each central stationary contact 7A, basing on small hole 5A of substrate 5 and small hole 2B of base sheet 2 for positioning, to form panel switch 8 having a plurality of arranged push switches.

Panel switch 8 mentioned above is mounted on an operation section of electronic equipment. When convex upper surface of a movable contact 1 is depressed by operation button (not shown) through cover sheet 3, convex bottom surface of movable contact 1 performs resilient motion with a click feeling to connect central stationary contact. Then, central stationary contact 7A of stationary contact substrate 5 and outside stationary contact 7B are electrically coupled to make a push switch ON stage. Upon release of depression from operation button, a resilient restoring force of movable contact 1 acts to disconnect convex bottom surface from central stationary contact 7A to return to push switch OFF stage as shown in FIG. 12.

However, in above mentioned conventional movable contact unit 4 and panel switch using the movable contact unit, ingress of dust between movable contact unit 4 and stationary contact substrate 5 moves in between movable contact 1 and stationary contact 7 to cause problems of loose connection in push switch of panel switch, during use of electronic equipment incorporated with panel switch having a combination of movable contact unit 4 and stationary contact substrate 5.

SUMMARY OF THE INVENTION

A movable contact unit disclosed in this invention comprises:

(a) a base sheet formed from a flexible insulation substrate having a plurality of through holes in predetermined positions;

(b) a plurality of movable contacts placed freely in vertical motion in respective through holes of the base sheet;

(c) a cover sheet formed from a flexible insulation substrate and bonded on upper surface of the base sheet, using adhesive coated on bottom surface of the cover sheet, to hold respective movable contacts in predetermined positions in the through holes of the base sheet; and (d) a weak adhesive layer applied on bottom surface of the base sheet except the through holes.

DESCRIPTION OF THE PREFERRED EMBODIMENTS

The present invention is described by following preferred embodiments with reference to FIG. 1 through FIG. 9. Here, perpendicular scale in each drawing is drawn enlarged for easy understanding and the similar configuration described in the conventional art have the same reference marks and the detailed descriptions thereof are simplified.

First Preferred Embodiment

Figure 1:
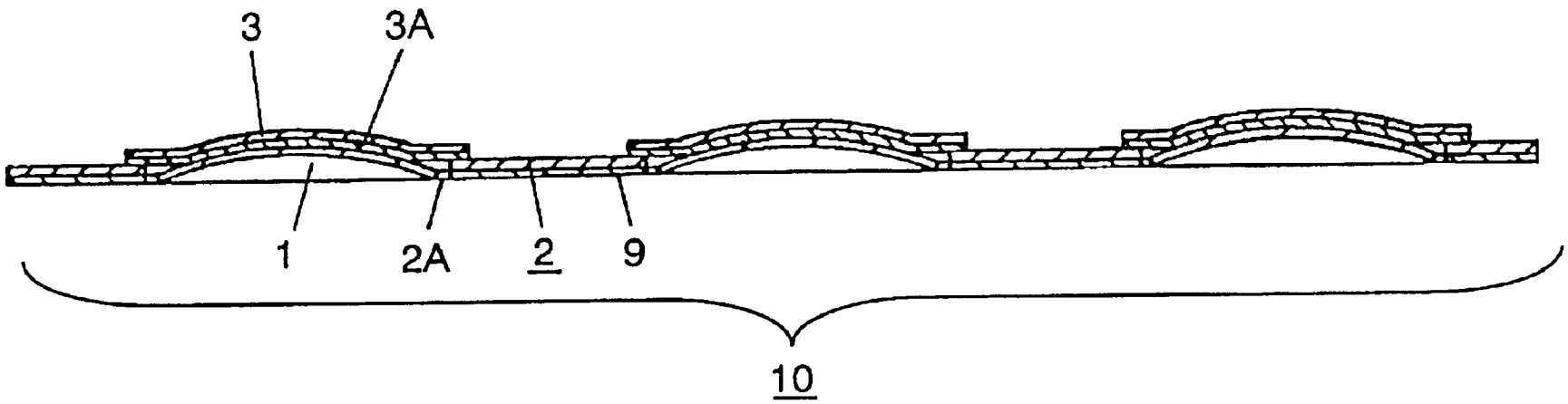
FIG. 1 is a cross-sectional front view of a movable contact unit used in a first preferred embodiment of the present invention.
Figure 2:
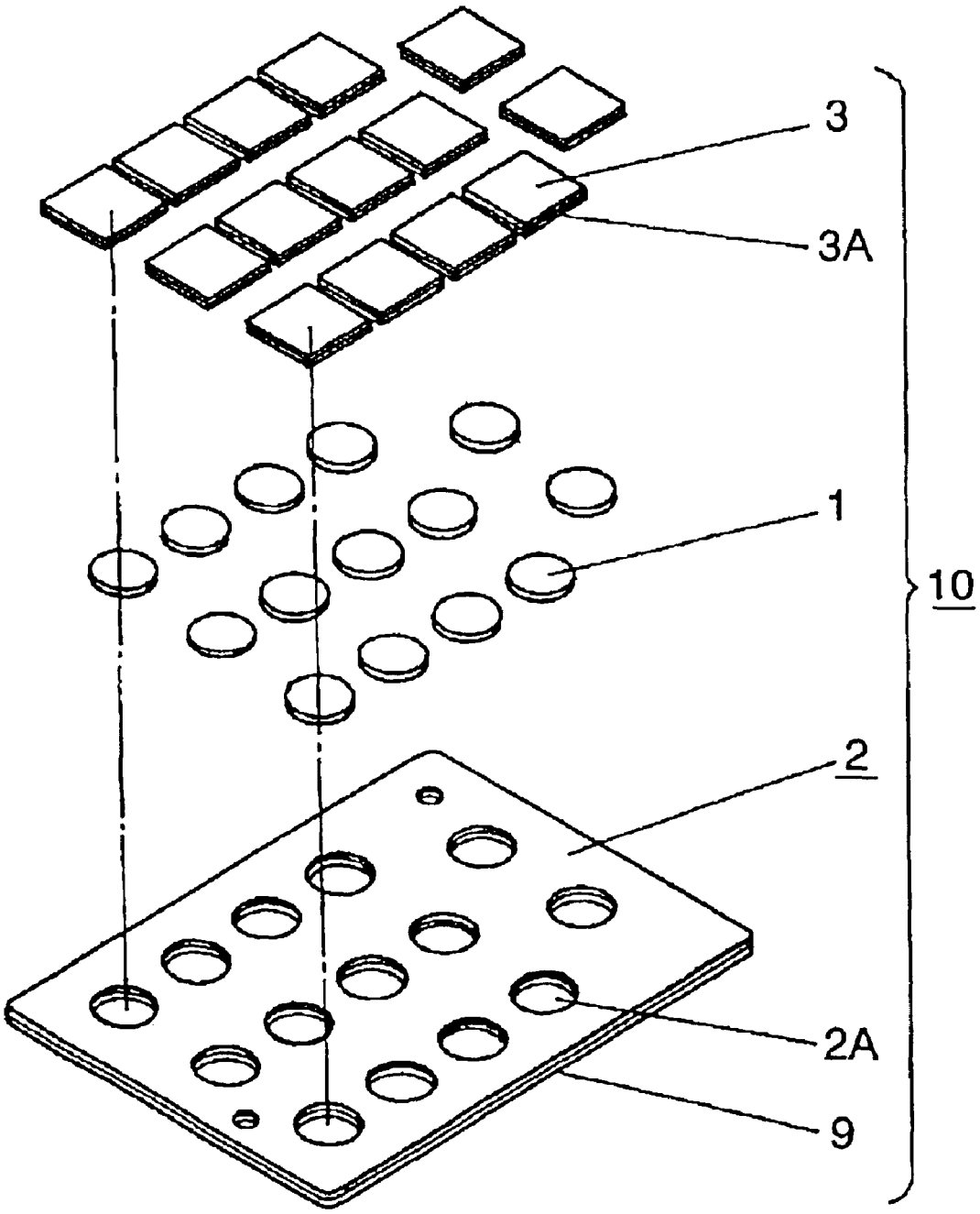
FIG. 2 is an exploded perspective view of a movable contact unit used in the first preferred embodiment of the present invention.

FIG. 1 is a cross-sectional front view of a movable contact unit used in the first preferred embodiment of the present invention and FIG. 2 is an exploded perspective view of the movable contact unit.

In FIG. 2, movable contact 1 formed from a resilient thin metal sheet has a round dome shape and base sheet 2 formed from a flexible insulation substrate has a plurality of through holes 2A in predetermined positions. Movable contacts 1 are placed freely in vertical motion in respective through holes 2A of base sheet 2. Cover sheet 3 formed from a flexible insulation substrate and coated with adhesive material 3A on bottom surface is bonded on individual convex upper surface of movable contact 1 to secure movable contact 1 on upper surface of base sheet 2.

The above mentioned configuration is the same as conventional art but movable contact unit 10 used in the first preferred embodiment for panel switch having a plurality of push switches is provided with weak adhesive layer 9 on bottom surface of base sheet 2 except through holes 2A.

A manufacturing method of movable contact unit 10 having weak adhesive layer 9 is described with reference to cross-sectional view shown in FIG. 3.

Figure 3A:
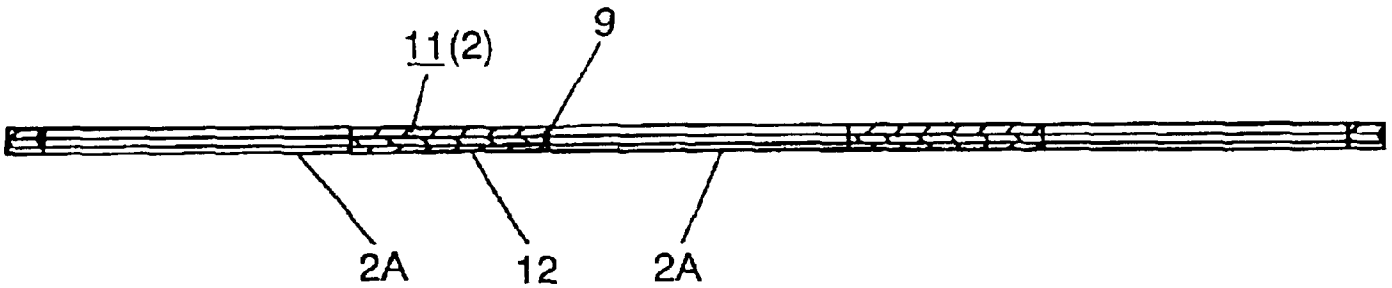
FIG. 3A is a cross-sectional schematic view for a manufacturing method of a movable contact unit used in the first preferred embodiment of the present invention.

First, whole bottom surface of flexible insulation substrate 11 of base sheet 2 is coated with a weak adhesive material to form weak adhesive layer 9 on the surface as shown in FIG. 3A.

In addition, a combination of flexible insulation substrate 11 and second flexible insulation substrate 12, thinner than flexible insulation substrate 11, bonded under weak adhesive layer 9 is die-punched to provide a plurality of through holes 2A in predetermined positions.

Figure 3B:
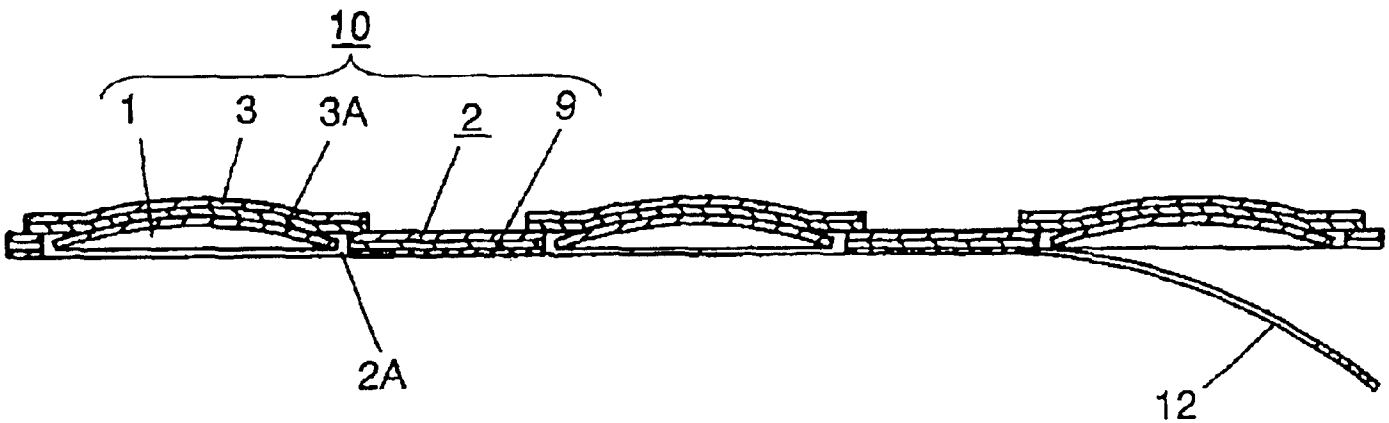
FIG. 3B is a cross-sectional schematic view for a forming method of a movable contact unit used in the first preferred embodiment of the present invention.

After the above processing, movable contacts 1 are placed on every through hole 2A from upper side of flexible insulation substrate 11, corresponds to base sheet 2 as shown in FIG. 3B.

Then, cover sheet 3 formed from a flexible insulation substrate and coated with adhesive material 3A on bottom surface is bonded on individual convex upper surface of movable contact 1 to hold movable contact 1, then cover sheet 3 is fixed on upper surface of base sheet 2.

Finally, second flexible insulation substrate 12 is peeled off from bottom surface of weak adhesive layer 9 to form a movable contact unit 10 having weak adhesive layer 9.

Here, weak adhesive material coated on bottom surface of flexible insulation substrate 11 contains a higher ratio of hardener to base resin compared with ordinary adhesive materials. Moreover, coating thickness of 5 to 10 □m for weak adhesive layer 9 is approx. one third of typical adhesive coating thickness. Bonded substrate can be peeled off easily without any damage on the surface, as peeling-off strength from weak adhesive layer 9 formed as mentioned above is of the order of approx. 100 gf/25 mm that is about one tenth for typical adhesives.

Figure 4:
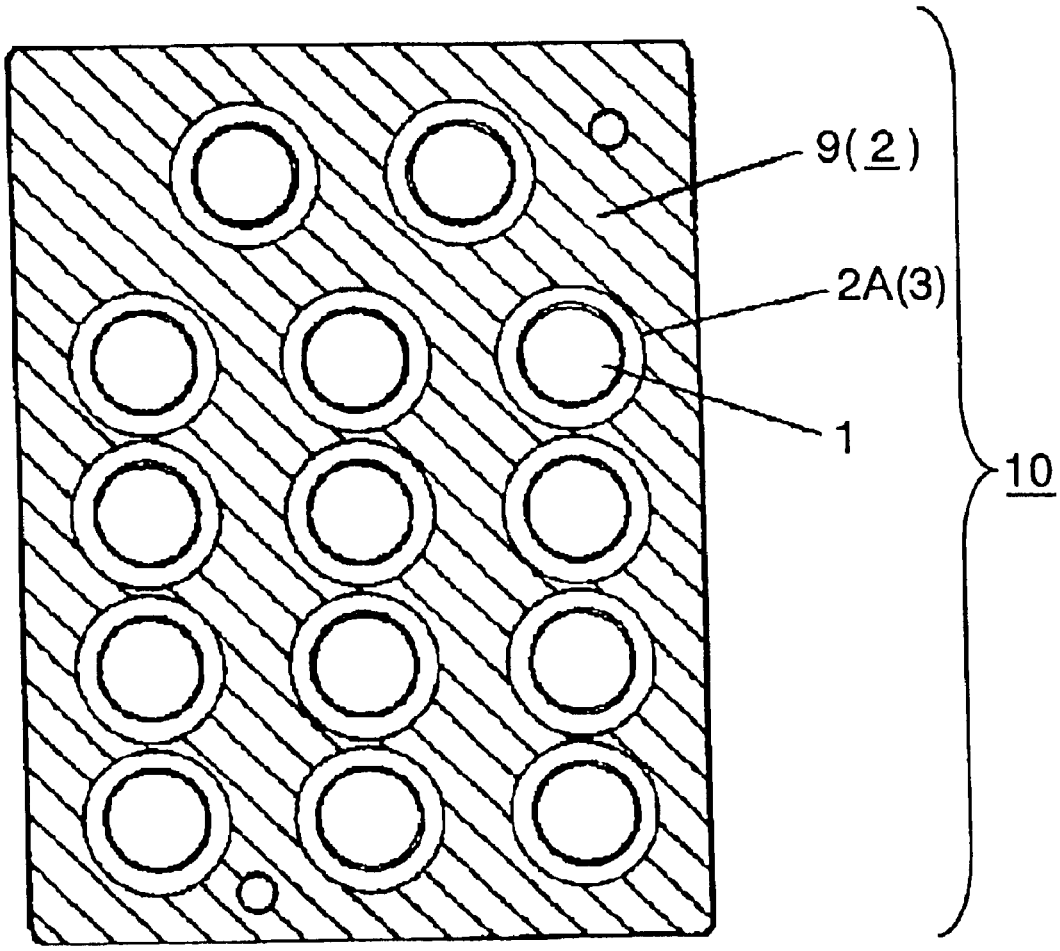
FIG. 4 is a bottom view of a movable contact unit used in the first preferred embodiment of the present invention.

In addition, in above mentioned manufacturing method, through holes 2A provided on base sheet 2 are punched out in larger size than outer diameter of round dome shaped movable contact 1 as shown in a bottom view of movable contact unit in FIG. 4.

Movable contact 1 is fixed by cover sheet 3 to keep a certain gap around movable contact 1 from inside diameter of through hole 2A, correspond to weak adhesive layer 9 (shown in hatching in the drawing).

Consequently, movable contact unit 10 can perform with an acceptable click feeling by depressing operation, as weak adhesive layer 9 does not influence round dome shaped movable contact 1.

Moreover, cover sheet 3 may not be applied individually as mentioned above, but can be a single sheet for fixing a plurality of neighboring movable contacts all together.

Additionally, if weak adhesive layer 9 is applied keeping a certain gap left from circumference of through hole 2A, adhesive layer 9 affects on movable contact 1 far less than conventional art.

Figure 5:
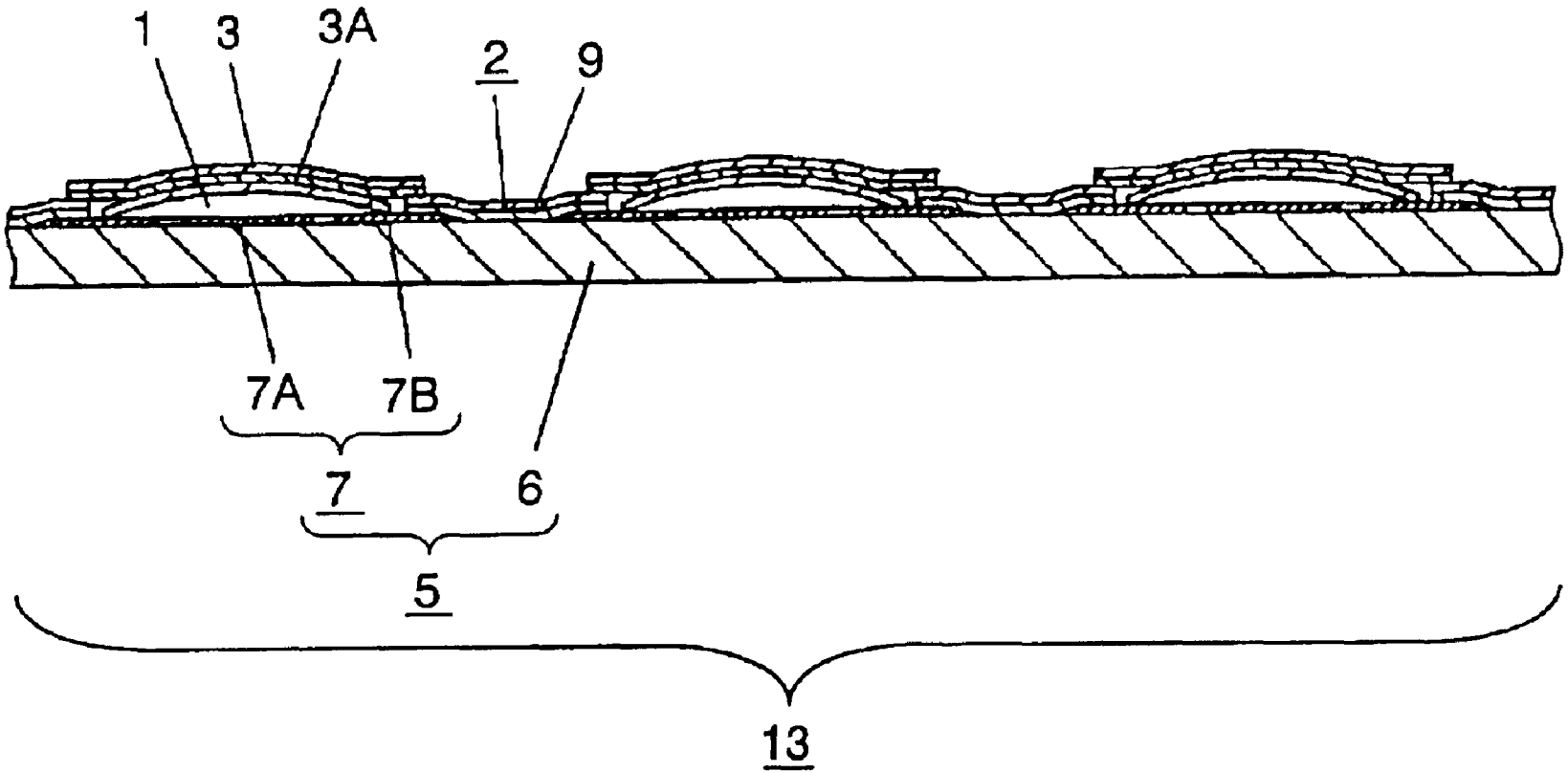
FIG. 5 is a cross-sectional front view of a panel switch using a movable contact unit used in the first preferred embodiment of the present invention.
Figure 6:
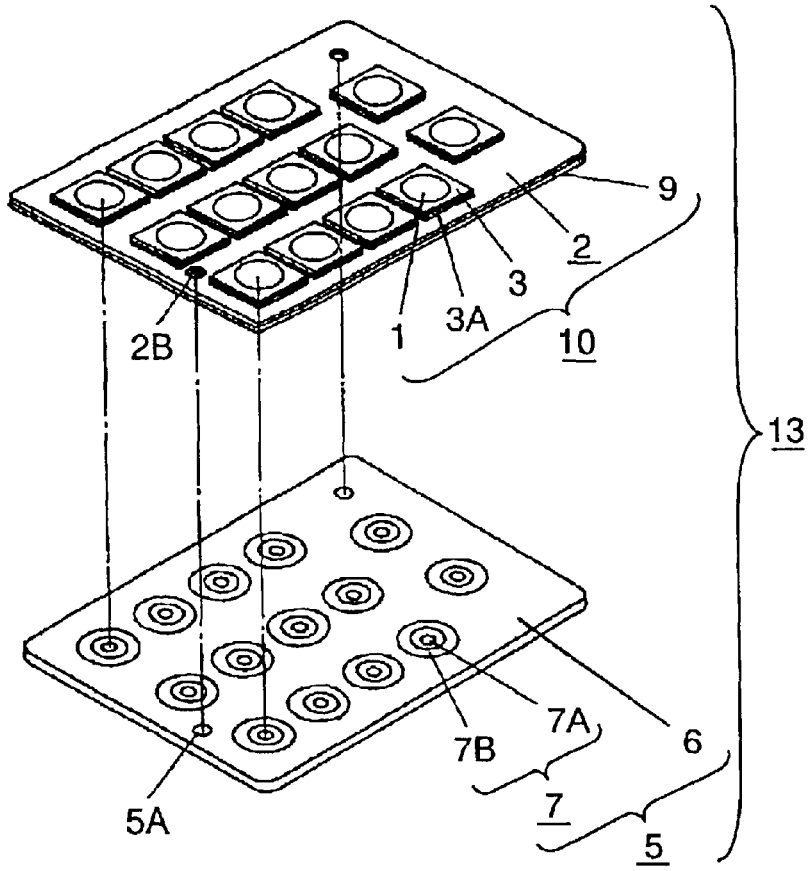
FIG. 6 is an exploded perspective view of a panel switch using a movable contact unit used in the first preferred embodiment of the present invention.

FIG. 5 is a cross-sectional front view of a panel switch using above mentioned movable contact unit 10, and FIG. 6 is an exploded perspective view of the panel switch. In FIG. 6, stationary contact substrate 5 has a plurality of stationary contact 7 consisted of central stationary contact 7A and peripheral stationary contact 7B on predetermined positions of hard plate-like insulation board 6: that is similar to conventional art.

Peripheral edge of each movable contact 1 of movable contact unit 4 is placed on corresponding peripheral stationary contact 7B such that convex bottom surface of movable contact 1 faces each central stationary contact 7A with a certain gap.

Basing on small hole 5A of substrate 5 and small hole 2B of base sheet 2 for positioning, movable contact unit 10 is stacked on stationary contact substrate 5 and is bonded together using weak adhesive layer 9 applied on bottom surface of base sheet 2 of movable contact unit 10 to form panel switch 13 having a plurality of arranged push switches.

Namely, operation of panel switch 13 to depress convex upper surface of round dome shaped movable contact 1 through cover sheet 3 is the same as conventional art, but ingress of dust between base sheet 2 and stationary contact substrate 5 is prevented, as bottom surface of base sheet 2 of movable contact unit 10 and stationary contact substrate 5 is bonded together using weak adhesive layer 9.

In addition, even if ingress of dust between the two occurred, dust can not move further, which contributes to little occurrence of loose connection of push switch, and movable contact 1 performs a steady resilient action, as a steady positioning of each movable contact 1 and corresponding each stationary contact 7 is maintained.

Moreover, weak adhesive layer 9 to bond movable contact unit 10 with stationary contact substrate 5 together has a weak peeling-off strength as afore-mentioned, the same as conventional art without any weak adhesive layer 9, in case of, for example, combination change of movable contact unit 10 and stationary contact substrate 5, if necessary, movable contact unit 10 can be peeled off easily from bonded stationary contact substrate without any damage and both can be reused.

Figure 7:
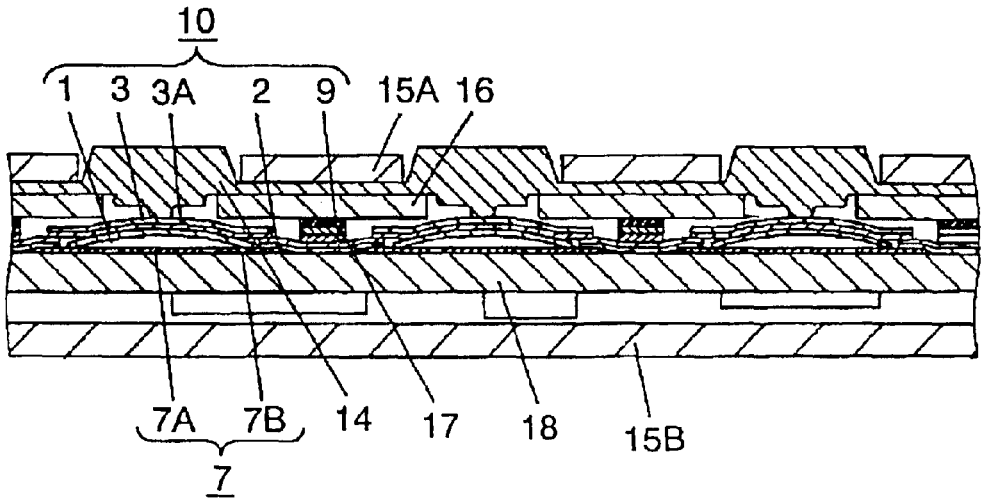
FIG. 7 is a partially cross-sectional front view of an electric equipment having a panel switch using a movable contact unit used in the first preferred embodiment of the present invention.

Next, FIG. 7 is a partially cross-sectional front view of a downsized electric equipment having a panel switch used in the first preferred embodiment.

As shown in FIG. 7, a plurality of operation buttons 14 formed from resilient insulation material and capable of free vertical motion exposes from upper housing 15A, which performs as an operation section of the electric equipment. A panel switch is fixed on fixing member 16 placed surroundings of a plurality of operation button 14 using double-faced member 17. Convex upper surface of each movable contact 1 of movable contact unit 10 touches bottom portion of each operation button 14 through cover sheet 3

Additionally, bonded stationary contact substrate 5 using weak adhesive layer 9 applied on bottom surface of base sheet 2 of movable contact unit 10 plays also a role of circuit board 18 for the electric equipment held in bottom side housing 15B. Namely, central stationary contact 7A and peripheral stationary contact 7B of each stationary contact 7 are mounted on upper surface of circuit board 18 directly.

Electric equipment with above configuration performs with steady operation condition and with little occurrence of loose connection in push switches of operation section due to a good dust-proof property as well as low machine profile and cheep prices. Moreover, movable contact unit 10 can be peeled off easily from circuit board 18 which acts as stationary contact substrate, together with weak adhesive layer 9, to exchange operation button 14 or fixing member 16 for a modification of operation section design of electronic equipment.

Second Preferred Embodiment

Figure 8:
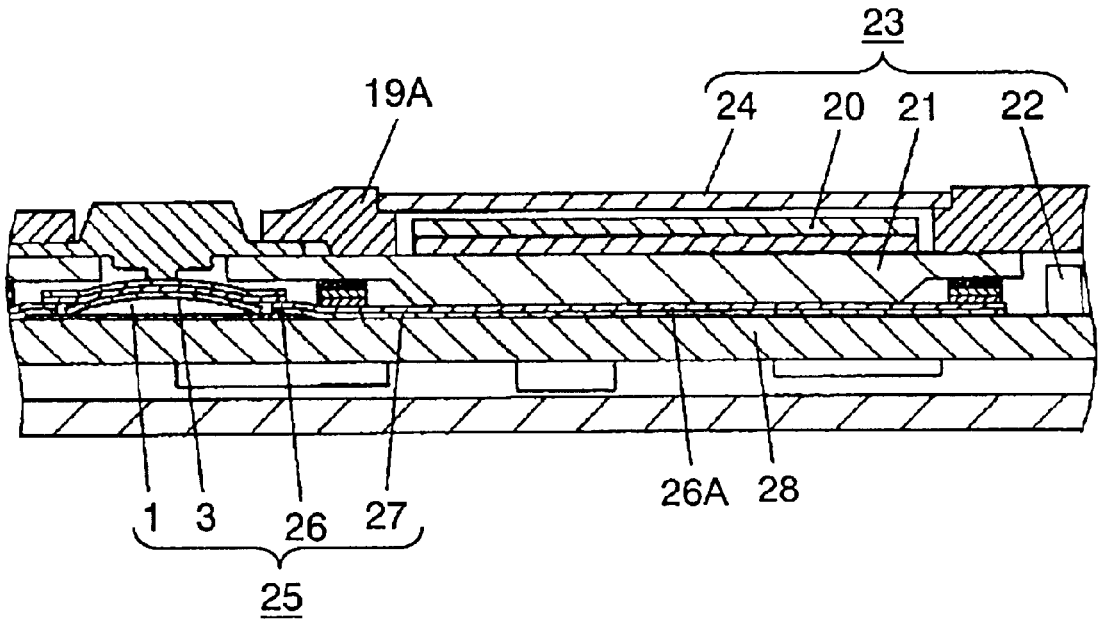
FIG. 8 is a partially cross-sectional front view of another example of electric equipment having a panel switch used in the first preferred embodiment of the present invention.

FIG. 8 is a partially cross-sectional front view of a downsized electric equipment having a panel switch used in the second preferred embodiment of the present invention. As shown in FIG. 8, the electric equipment comprises LCD (liquid crystal display) unit 20 exposed from upper side housing 19A, light guide 21 secured on bottom surface of the housing, and display section 23 having light source 22 disposed at surrounding sides of the display section. Transparent protective lens 24 is mounted on upper surface of LCD display unit 20.

In addition, extension section 26A extended from base sheet 26 of movable contact unit 25 of the panel switch is provided at the bottom surface side of light guide 21, and is bonded on circuit board 28 of the electric equipment with weak adhesive layer 27 coated on bottom surface, to mount the extension section such that contacts bottom surface of light guide 21.

Figure 9:
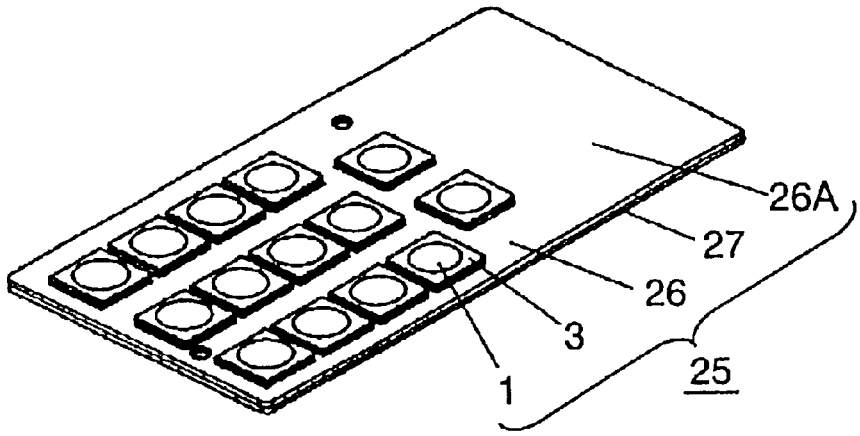
FIG. 9 is an appearance view of a movable contact unit used in the first preferred embodiment of the present invention.
Figure 10:
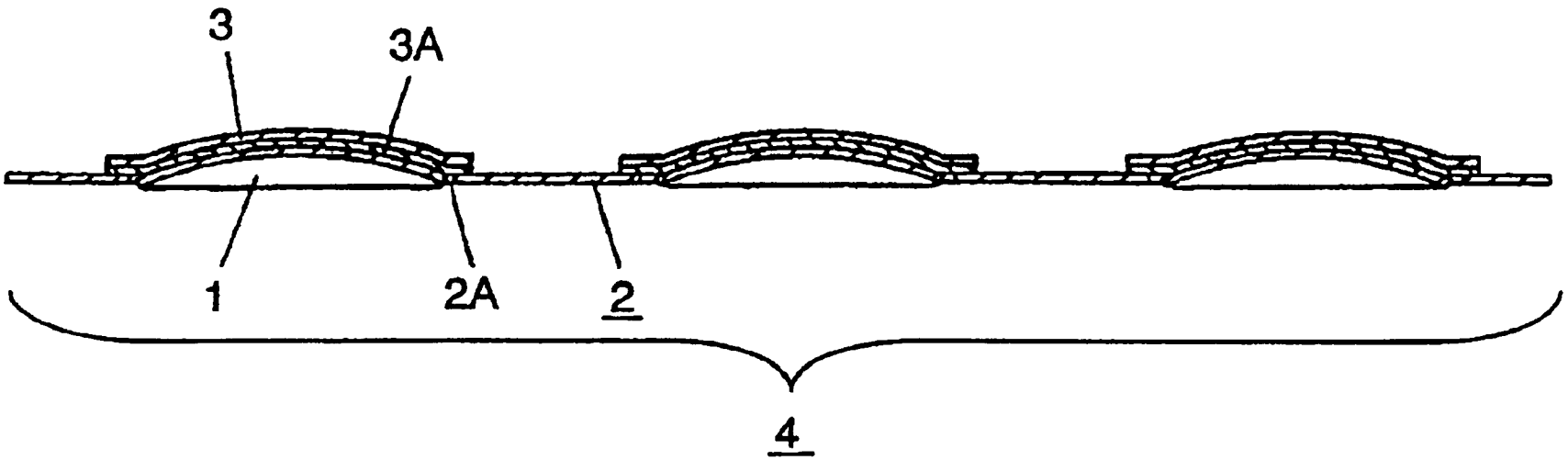
FIG. 10 PRIOR ART
FIG. 10 is a cross-sectional front view of a conventional movable contact unit.
Figure 11:
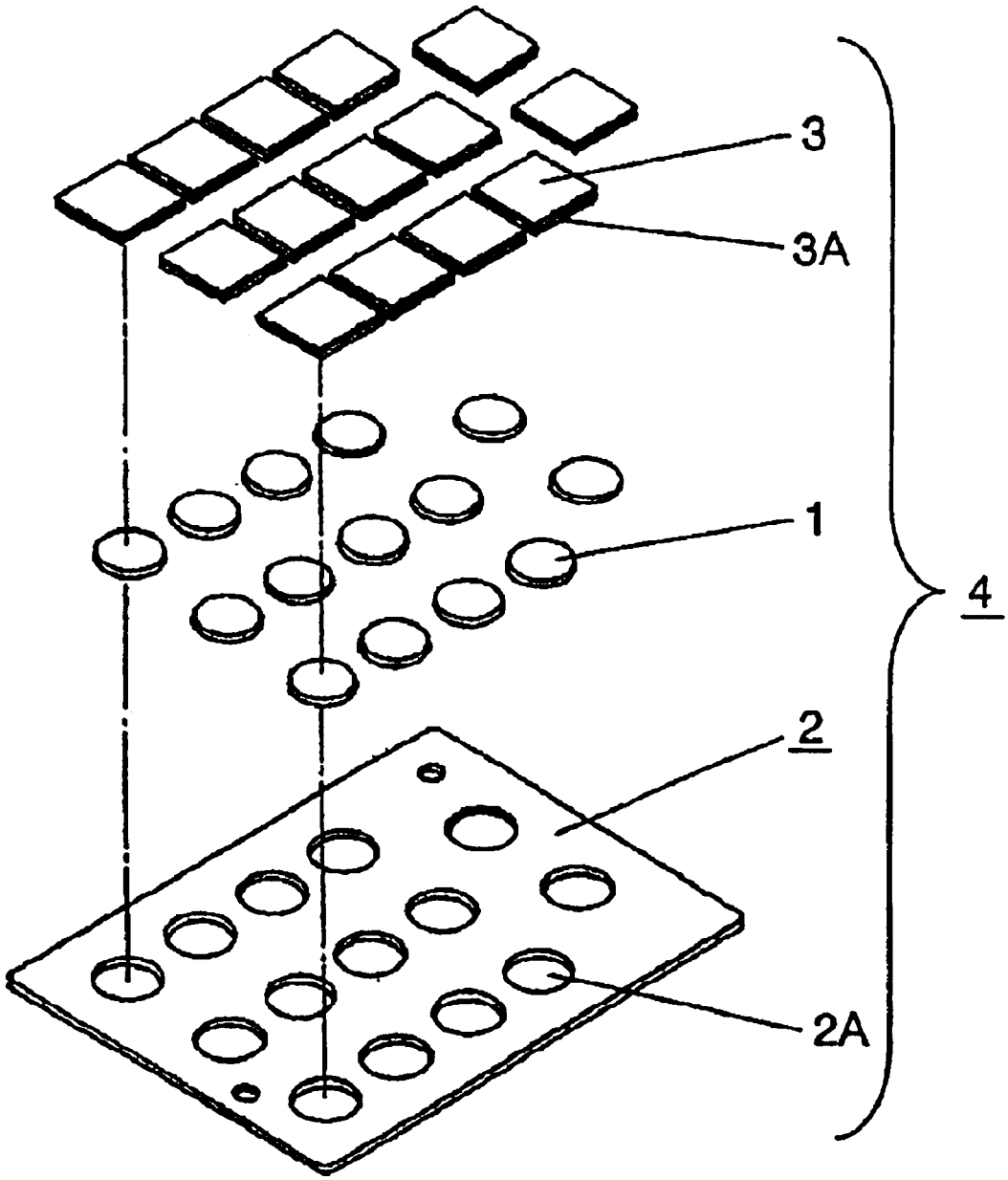
FIG. 11 PRIOR ART
FIG. 11 is an exploded perspective view of a conventional movable contact unit.
Figure 12:
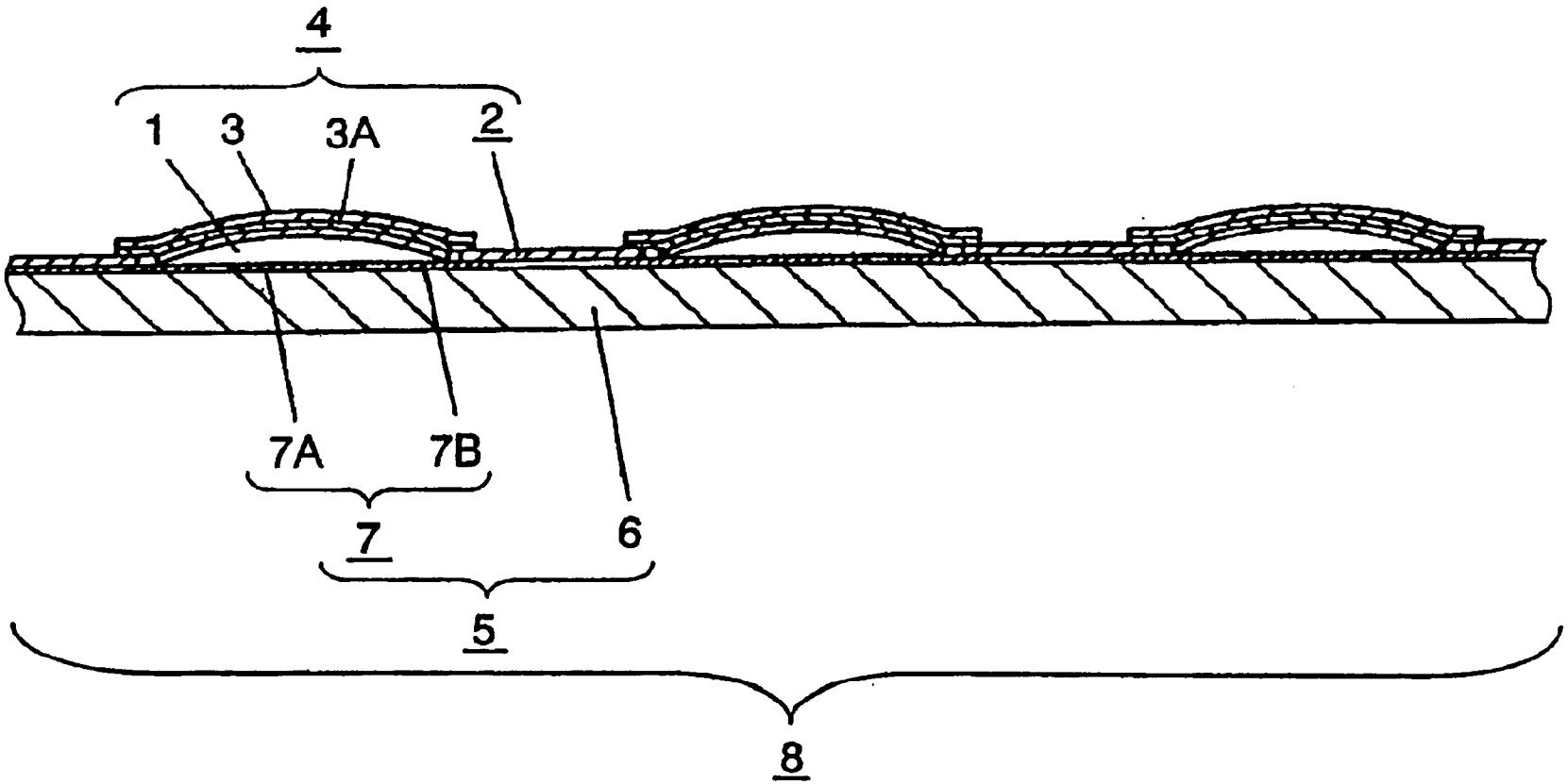
FIG. 12 PRIOR ART
FIG. 12 is a cross-sectional front view of a panel switch using a conventional movable contact unit.
Figure 13:
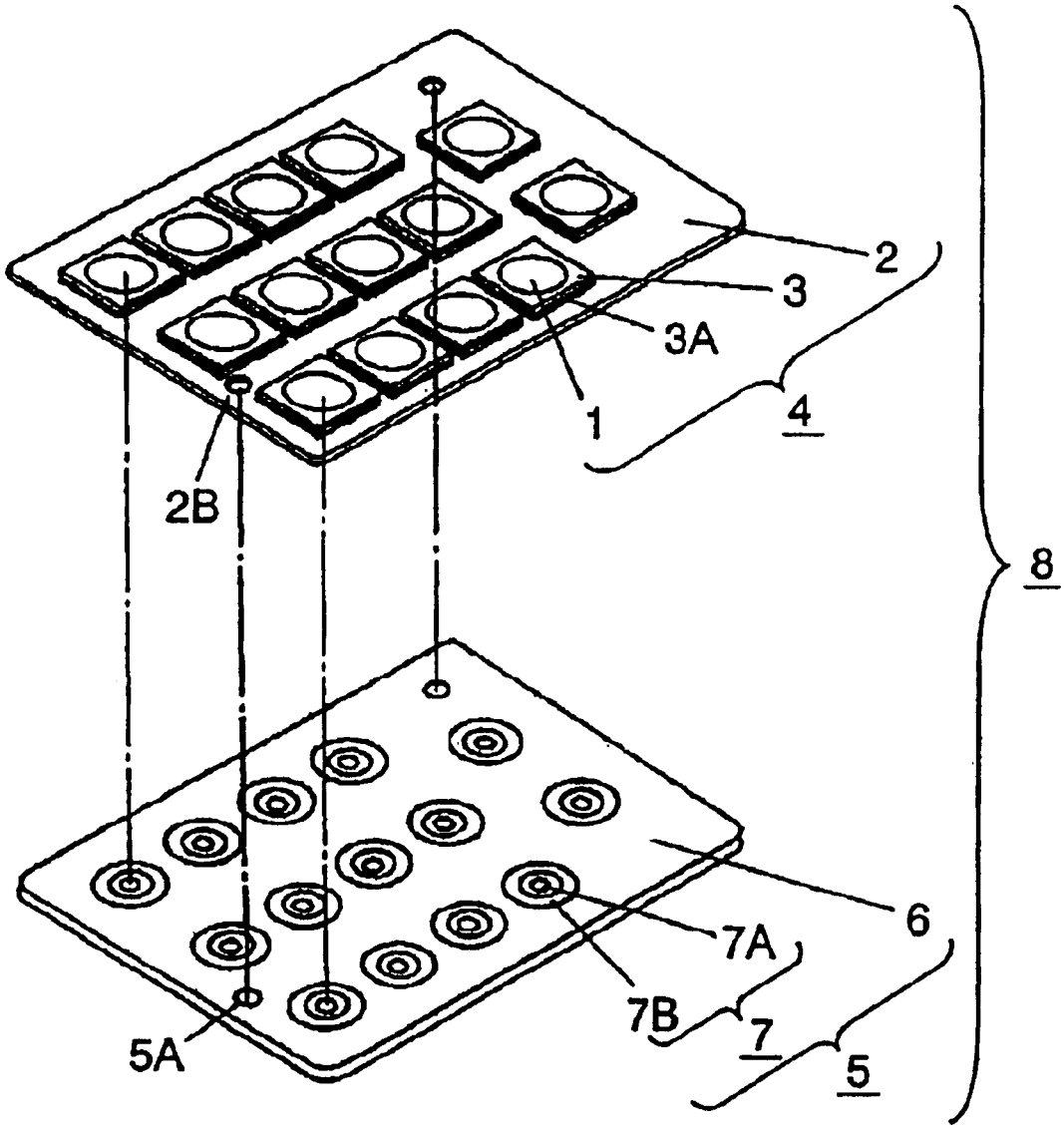
FIG. 13 PRIOR ART
FIG. 13 is an exploded perspective view of a panel switch using a conventional movable contact unit.

Movable contact unit 25 has an extended section of a predetermined length in one end of base sheet 26 consisted of whitish flexible insulation substrate with weak adhesive layer 27 coated on bottom surface as shown in an appearance view in FIG. 9. Extension section 26A is bonded flatly on plate-like circuit board 28 to act a light reflector for light guide 21.

The invention thus contributes a development of electronic equipment having brighter and steadier display section 23 with cheaper cost prices.

According to the above, as the bottom surface of base sheet of movable contact unit is bonded stationary contact substrate using weak adhesive layer, not only the ingress of dust between movable contact unit and stationary contact substrate is prevented but the dust, even if entered, is difficult to move further, which contributes to little occurrence of loose connection of push switch and to keep a steady positioning of each movable contact and corresponding each stationary contact.

Moreover, the movable contact unit has an advantageous capability of peeling movable contact unit off from bonded stationary contact substrate easily and without any damage.

What is claimed is:

1. A movable contact unit comprising:

a base sheet comprising a first flexible insulation substrate having a plurality of through holes in predetermined positions;

a plurality of movable contacts located for moving vertically in the through holes of said base sheet;

a cover sheet comprising a second flexible insulation substrate having an adhesive coating on a bottom surface thereof, and bonded to an upper surface of said base sheet said adhesive coating to hold said movable contacts in predetermined positions in the through holes of said base sheet; and a weak, easily peelable adhesive layer on a bottom surface of said base sheet except the through holes, wherein said movable contact unit is for adhering to a stationary contact substrate, and said weak, easily peelable adhesive layer has an adhesion strength weak enough to avoid damaging a stationary contact substrate upon separation of the contact unit therefrom after being adhered thereto.

2. The movable contact unit of claim 1, wherein each of said movable contacts comprises a resilient thin metal sheet having a dome shape, and a convex upper surface of each of said movable contacts is bonded to said adhesive coating on the bottom surface of said cover sheet to hold said movable contacts in the through holes of said base sheet.

3. The movable contact unit of claim 2, wherein said weak, easily peelable adhesive layer the bottom surface of said base sheet comprises a gap around each movable contact.

4. A panel switch, comprising:

a movable contact unit comprising:

a base sheet comprising a first flexible insulation substrate having a plurality of through holes in predetermined positions;

a plurality of movable contacts placed located for moving vertically in the through holes of said base sheet;

a cover sheet comprising a second flexible insulation substrate and having an adhesive coating on a bottom surface thereof, and bonded to an upper surface of said base sheet said adhesive coating to hold said movable contacts in predetermined positions in through holes of said base sheet; and a weak easily peelable adhesive layer on a bottom surface of said base sheet except the through holes; and a stationary contact substrate comprising:

a rigid insulation board;

stationary contacts corresponding to said movable contacts and mounted on said insulation board; and said movable contact unit and said insulation board bonded together by said weak adhesive layer on the bottom surface of said base sheet of said movable contact unit, wherein said weak, easily peelable adhesive layer has an adhesion strength weak enough to avoid damaging said insulation board upon separation of the movable contact unit therefrom after being adhered thereto.

5. An electronic equipment, comprising:

a bottom housing and an upper housing, said upper housing having an operation section comprising a plurality of operation buttons on a surface of the upper housing, each of said operation buttons operatively connected to a panel switch located at a bottom side thereof each panel switch comprising:

a movable contact unit comprising:

a base sheet comprising a first flexible insulation substrate having a plurality of through holes in predetermined positions;

a plurality of movable contacts located for moving vertically in the through holes of said base sheet;

a cover sheet comprising a second flexible insulation substrate and having an adhesive coating on a bottom surface thereof, and bonded to an upper surface of said base sheet by said adhesive coating to hold said movable contacts in predetermined positions in through holes of said base sheet; and a weak easily peelable adhesive layer on a bottom surface of said base sheet except the through holes;

a stationary contact substrate comprising:

a rigid insulation board;

stationary contacts corresponding to each of said movable contacts and mounted on said insulation board, wherein said movable contact unit and said stationary contact substrate are bonded together by said weak, easily peelable adhesive layer on the bottom surface of said base sheet of said movable contact unit, so that said stationary contact substrate is attached to the bottom housing, and said weak, easily peelable adhesive layer has an adhesion strength weak enough to avoid damaging said insulation board upon separation of the movable contact unit therefrom after being adhered thereto.

6. The electronic equipment of claim 5, further comprising:

a display section having an LCD unit for providing a display visible from an upper side of the upper housing;

a light guide secured on a bottom surface of the LCD unit, for conveying light from light sources located at sides of the light guide;

a circuit board; and an extension section extending from said base sheet comprising a portion extending along a bottom surface of said light guide, said extending portion having a bottom surface bonded to the circuit board by said weak adhesive layer.

* * * * *

UNITED STATES PATENT AND TRADEMARK OFFICE

CERTIFICATE OF CORRECTION

PATENT NO. : 6,906,275 B2
DATED : June 14, 2005
INVENTOR(S) : Hiromichi Koyama et al.

It is certified that error appears in the above-identified patent and that said Letters Patent is hereby corrected as shown below:

Column 5,
Line 65, insert -- by -- before "said adhesive coating".

Column 6,
Line 18, insert -- on -- before "the bottom surface".
Line 27, delete "placed".
Line 33, insert -- by -- before "said adhesive coating".

Signed and Sealed this

Twenty-fourth Day of January, 2006

JON W. DUDAS
*Director of the United States Patent and Trademark Office*